United States Patent [19]

Goetz

[11] Patent Number: 4,627,710

[45] Date of Patent: Dec. 9, 1986

[54] CUSTOMIZED JOB DEFAULT SET-UP

[75] Inventor: Frank M. Goetz, Fairport, N.Y.

[73] Assignee: Xerox Corporation, Stamford, Conn.

[21] Appl. No.: 707,778

[22] Filed: Mar. 4, 1985

[51] Int. Cl.[4] ..... G03G 21/00

[52] U.S. Cl. ..... 355/14 R; 355/14 C

[58] Field of Search ..... 355/3 R, 14 R, 14 C

[56] References Cited

U.S. PATENT DOCUMENTS

| | | | |
|---|---|---|---|
| 3,790,270 | 2/1974 | Donohue | 355/14 |
| 3,796,486 | 3/1974 | Donohue et al. | 355/16 |
| 3,917,396 | 11/1975 | Donohue et al. | 355/14 |
| 4,054,380 | 10/1977 | Donohue et al. | 355/14 |
| 4,090,787 | 5/1978 | Hubbard et al. | 355/14 R |
| 4,227,798 | 10/1980 | Steiner | 355/14 C |
| 4,478,509 | 10/1984 | Daughton et al. | 355/14 C |

*Primary Examiner*—Fred L. Braun

*Attorney, Agent, or Firm*—R. F. Chapuran

[57] ABSTRACT

A procedure for customizing job default or set-up parameters. In particular, by entering a job default change mode, the operator can selectively alter the power up or the cycle out conditions in which the machine reverts to after the end of a job run, at start up or at preselected time outs. For example, if the machine generally defaults to a simplex to simplex, paper feed from tray 1, and 1 to 1 magnification mode, this condition can be changed to a duplex to duplex, tray 2, and reduction mode and thereafter the machine will power up to or default to that particular configuration. This is done by exiting to the change parameter condition, selecting the new parameters at the control console, storing the new parameters and exiting back to the normal run mode.

5 Claims, 6 Drawing Figures

CUSTOMIZED JOB DEFAULT SET-UP

This invention relates to electrostatographic xerographic type reproduction machines and more particularly to an improved control system for such machines.

The advent of higher speed and more complex copiers in reproduction machines has brought with it the corresponding increase in the complexity in the selection and type of jobs the machine may do. To effectuate job selection on machines of this type, a somewhat sophisticated control console or programmer is provided for the operator's use.

These present day complex machines include such devices as automatic document handlers, sorters, staplers and other finishing devices. In addition, these machines are provided with various options or set-up parameters for a particular job, such as copy mode, paper supply, stapler, copy output, contrast, density, exposure, reduction, and image shift. That is, the operator can choose, for example, between simplex to simplex, or simplex to duplex, or duplex to duplex copying. The operator can also select copy sheet delivery from a selected copy sheet tray and can also select a particular finishing option such as stapled sets, non-stapled sets, or collated sets. Also, there are the usual options for contrast, density, exposure, reduction and image shift.

In the prior art, it is known to be able to set a given set of parameters for a given job requirement. It is even known to set another given set of parameters for another job to be initialized after the completion of the first job. This is known generally as pre-programming or pre-job set-up.

In the prior art, however, at power up or at cycle down at the completion of a job, the machine always returned to a fixed, unchangable set of parameters, even if that particular set of parameters which was selected was seldom, if ever used in a job requirement. These fixed parameters are often called the default set of parameters, those parameters the machine reverts to upon power up, cycle out or at preselected time outs.

By being locked into a fixed set of default parameters, the machine lacks flexibility and the capability of being adapted to a more generally used default condition. It would be desirable, therefore, to be able to selectively reset or change the default in a machine the job parameters that would remain even after the completion of the job and a power up condition.

An object of the present invention, therefore, is to provide a new and improved control for a machine to be able to adapt the machine to different power up or cycle out parameters.

Another object of the present invention is to be able to customize the default or power up and cycle out condition of the machine to a set of job parameters as the situation requires.

Further advantages of the present invention will become apparent as the following description proceeds and the features characterizing the invention will be pointed out in the claims annexed to and forming a part of this specification.

Briefly the present invention is concerned with customizing job default or set-up parameters. In particular, by entering a job default change mode, the operator can selectively alter the power up or the cycle out conditions in which the machine reverts to after the end of a job run, at start up or at preselected time outs. For example, if the machine generally defaults to a simplex to simplex, paper feed from tray 1, and 1 to 1 magnification mode, this condition can be changed to a duplex to duplex, tray 2, and reduction mode and thereafter the machine will power up to or default to that particular configuration. This is done by exiting to the change parameter condition, selecting the new parameters at the control console, storing the new parameters and exiting back to the normal run mode.

For a better understanding of the present invention, reference may be had to the accompanying drawings wherein the same reference numerals have been applied to like parts and wherein.

Figure 1:
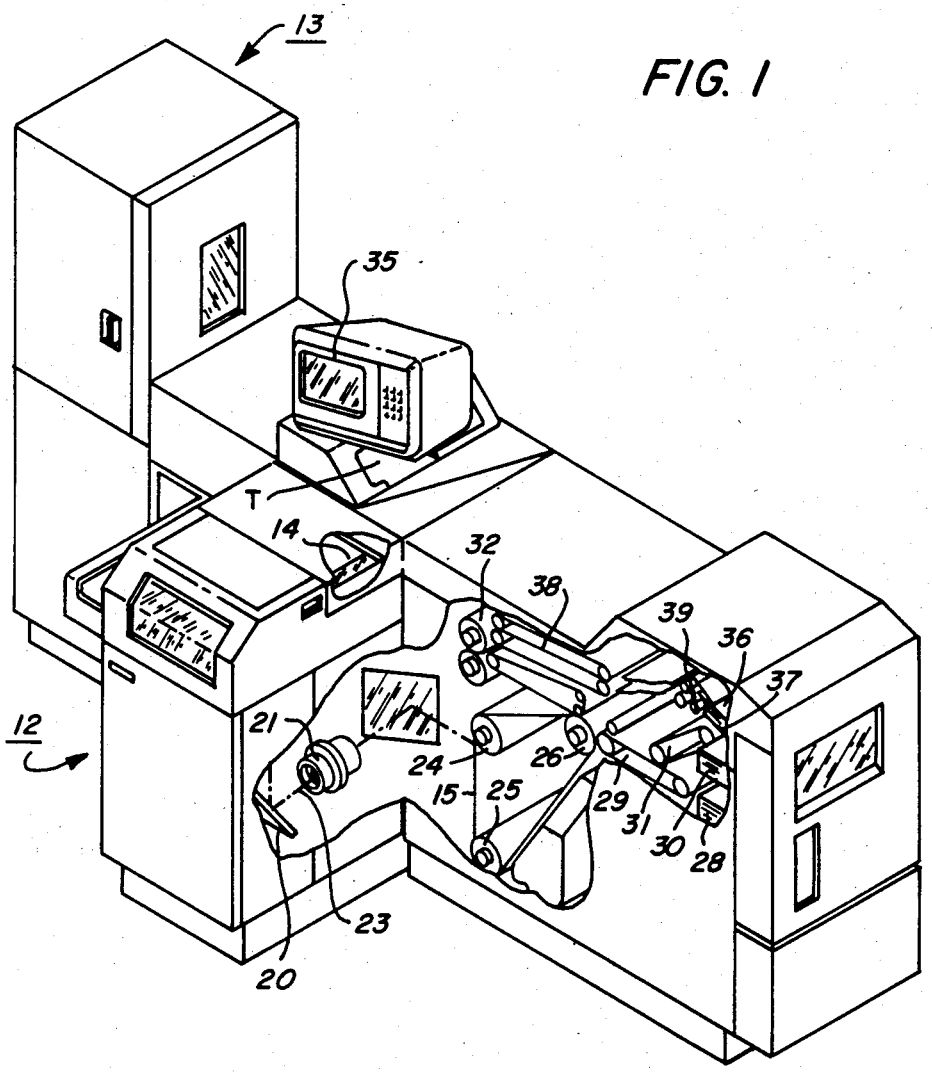
FIG. 1 is a prospective view of a duplicating system incorporating the customized job default set-up of the present invention.
Figure 2:
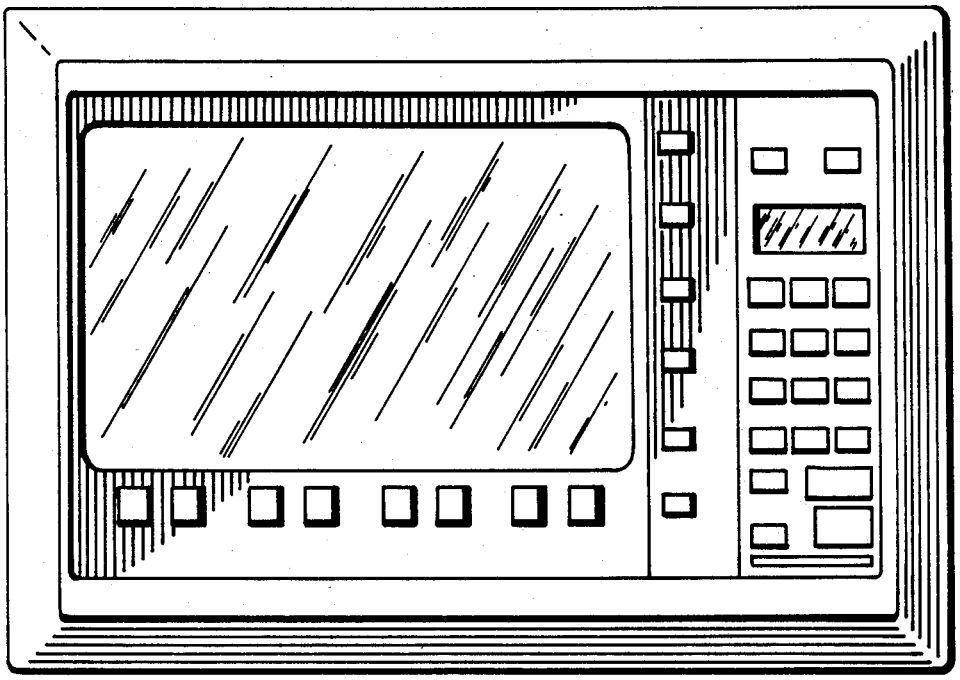
FIG. 2 illustrates in more detail the control console display for a customized job set-up.

For a general understanding of an automatic electrostatographic duplicating machine to which the present invention may be incorporated, reference is made to FIGS. 1 and 2 wherein components of a typical electrostatographic printing machine are illustrated. The printing system is preferably of the xerographic type as one including a xerographic processor 11, a document handling apparatus 12, and a sorter arrangement 13. Preferably, the printing system 11, 12 and 13 is the commercial, highly sophisticated embodiment of the Xerox machine model 9500 which utilizes flash, full frame exposure, for very high speed production. Document sheet handling and exposure, image processing and copy sheet transport/handling are under control by a machine programmer and are effected in timed sequence in conjunction with the machine clock system, and in accordance with the program an operator has preset in the machine. Further details in this regard are not necessary since the Xerox 9500 Duplicator operates in this manner and is well known. Details of the timing relationships and devices, the programmer, and related structure and events are described in U.S. Pat. Nos. 3,790,270; 3,796,486; and 3,917,396, commonly assigned and which are incorporated by reference.

As in all xerographic systems, a light image of an original to be reproduced, or an electronic facsimile thereof is projected onto the sensitized surface of an xerographic photosensitive surface to form an electrostatic latent image thereon. Thereafter, the latent image is developed with toner material to form a xerographic powder image corresponding to the latent image on the photosensitive surface. The powder image is then electrostatically transferred to a record material such as a sheet or web of paper or the like to which it may be fused by a fusing device whereby the powder image is caused to adhere permanently to the surface of the record material.

The xerographic processor 11 is arranged as a self-contained unit having all of its processing stations located in a unitary enclosure or cabinet. The processor includes an exposure station at which a document sheet to be reproduced is positioned on a glass platen 14 for projection onto a photosensitive surface in the form of a xerographic belt 15. The document or set of individual document sheets is selectively transported by the document feed apparatus 12 including a transport belt from the beginning of the set of sequenced document sheets in the apparatus to the platen for exposure a predetermined number of times and then returned on completion of these exposures until the entire stack has been copied, at which time the document set handling cycle may be repeated indefinitely as described in U.S. Pat. No. 3,829,082 entitled "Automatic Document Handler" and commonly assigned with the present invention.

Imaging light rays from the document which is flash illuminated by suitable lamps are projected by first mirror 20 and a projection lens 21 and another mirror 22 onto the xerographic belt 15 at the focal plane for the lens 21 along a path indicated by dotted lines 23.

The xerographic belt 15 is mounted for movement around three parallel arranged rollers 24, 25, and 26 suitably mounted in the frame of processor 11. The belt is continuously driven by a suitable motor (not shown) and at an appropriate speed. The exposure of the belt to the imaging light rays fron the document discharges the photoconductive layer in the area struck by light whereby there remains on the belt an electrostatic image corresponding to the light image projected from the document. As the belt continues its movement, the electrostatic latent image passes a developing station at which there is positioned a developer apparatus 27 for developing the electrostatic latent image.

After development, the powdered image is moved to an image transfer station whereat record material or sheets of paper was previously separated from either a sheet supply stack on a main sheet feed apparatus 28 and transported by a conveyor 29 or from a similar stack on an auxiliary sheet feed mechanism 30 and transported by a conveyor 31, to the transfer station. At the transfer station, the sheet is held against the surface of the moving belt to receive the developed powder image therefrom. The sheet is moved in synchronism with the movement of the belt during transfer of the developed image. After transfer, the sheet of paper is conveyed to a fusing station where a fuser device 32 is positioned to receive the sheet of paper for fusing the powder thereon. After fusing, the sheet may be transported selectively to a catch tray, the sorter 13, or finisher (not shown).

The reproduction system 11, 12, and 13 is under control of a programmer 35 as shown in FIG. 2 which premits an operator various options, for example, to turn the entire system ON or OFF; to program the reproduction system for a desired number of reproduction sets to be made of an original document set; to select one of many different copy reduction sizes; and to select whether simplex or duplex copies to be made. If the duplex copying mode is selected, each sheet of copy paper bearing an image and which has passed through the fusing apparatus 32 is transported to the top of a dedicated duplex tray apparatus 36 having a bottom sheet feed device 37 by way of a transport 38. The duplex tray 36 stores one-sided copy sheets until such appropriate time as determined by the programmer 35. The apparatus 36 commences transporting the stored sheets by way of a conveyor 39 which again presents the sheets to the xerographic belt 15 for permitting the transfer of developed images thereon to the second side of the sheets. The duplex copies are again transported to the fusing apparatus whereat the second sided images are fixed.

Further details of the processing devices and stations in the printer system are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

The duplicating machine 11, 12 and 13 exemplifying a variety of high speed duplicating systems with flexible and sophisticated features and options to automatically and conveniently process and manipulate copies or copy sets by varied selective methods or sequences, for the purpose of receiving copies in any of numerous desired quantities, formats enhancements, and arrangements, is adapted to be converted to copying document material or the like with many convenient and automatic control features and much versatility. The resulting apparatus provides the full compliment of processing and manipulating features for copying from document sheets and document sets.

The control of all of the exemplary systems disclosed herein may be accomplished by conventionally activating them by signals from the controller/programmer 35 in response to simple programmed commands and switch inputs from the copier console selected by the operator, such as selecting the number of copies, selecting simplex or duplex copying, selecting whether the document are simplex or duplex, etc. These signals may conventionally actuate conventional electrical solenoid or cam controlled sheet deflector fingers and drive motors or their clutches in the selected steps or sequences as programmed. Conventional sheet path sensors or switches and bail bars, connected to the controller, may be utilized for counting and keeping track of the positions of documents and copy sheets, as is well known in the art, and taught in the above and other patents and products. Known post-collation copying systems utilize such conventional microprocessor control circuitry and connecting switches for counting the number of document sheets as they are exposed a predetermined number of times when placed upon the exposure platen 14, counting the number of completed document set circulations, and thereby controlling the operation of the document and copy sheet feeders and inventers, etc.

Figure 3:
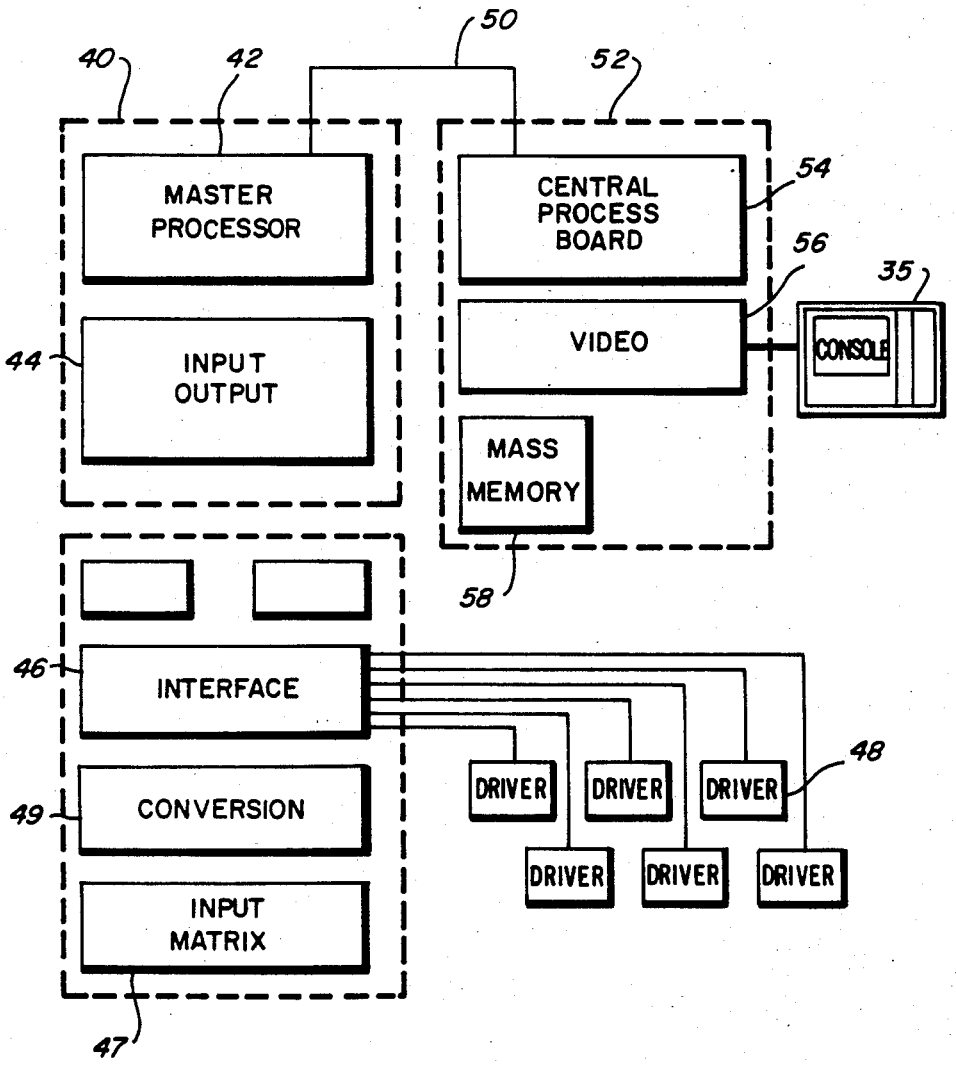
FIG. 3 is a general block diagram of the control of the reproduction machine illustrated in FIG. 1.

With reference to FIG. 3, there is illustrated a general block diagram of the control of the reproduction machine shown in FIG. 1. In general, there is a base machine controller illustrated at 40 including a master processor board 42 with a suitable microprocessor and an input output board 44 with suitable non-volatile memory. The base machine controller also is interconnected to the host machine or reproduction machine electronics including a low voltage power supply and an A/O panel. In addition, there is a controller interface 46 connected to several drivers illustrated at 48 to drive the machine components, an input matrix 48 receiving switch and sensor inputs and a digital to analog conversion board 48. The base machine controller 40 is connected by a serial communication channel to an operator interface controller 52. The operator interface controller 52 includes a central processing unit board 54, a video board 56 connected to the control console 35, and suitable mass memory 58.

Figure 4:
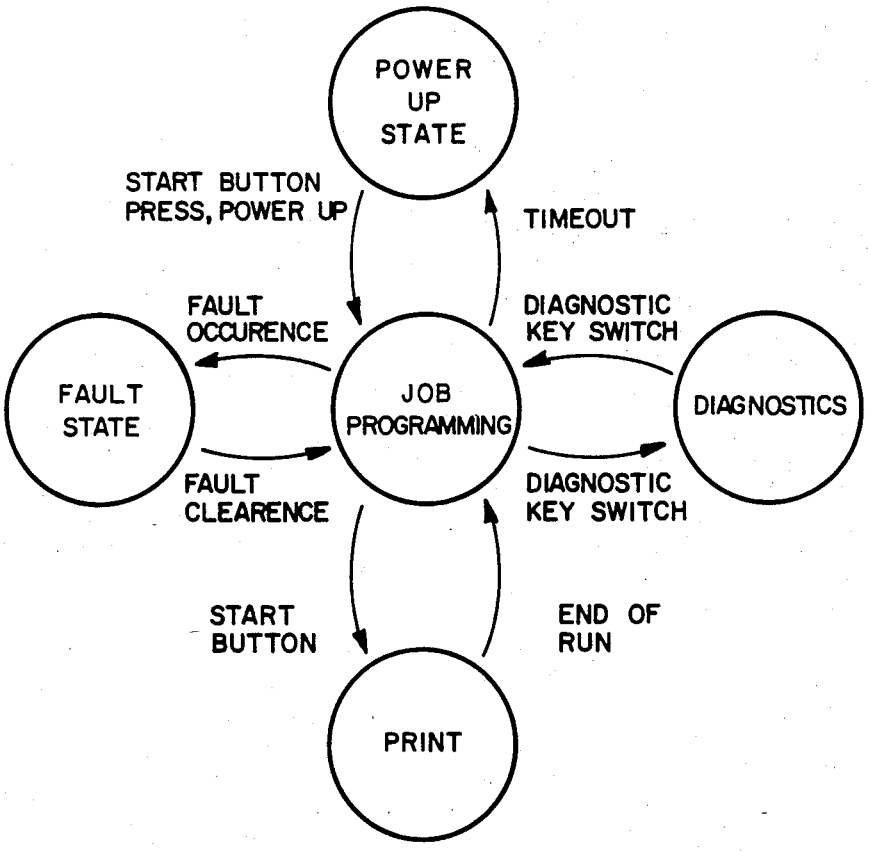
FIG. 4 is a simplified state diagram of the customized job set-up according to the present invention.

At specific times during the operation of a machine, the machine will revert to a set of preset conditions or job default parameters. This occurs most often at the completion of a job run, power up or at preselected time outs. As illustrated in the state diagram at FIG. 4, a job programming state which includes a default condition state and is related to several other states. In particular, the system advances from the job programming state to the print state upon activation of the start print button and returns from the print state back to the job programming state after an end of run. Also, the diagnostic state will be reached from the job programming state upon the activation of a diagnostic switch with a return to the job programming state from the activation of the diagnostic switch. Also, the system goes from a power up/walk up state upon a start button activation to the job programming state and returns to the power up/-walk up state from the job programming state upon a suitable time out. Finally, the transition between job programming and the fault state is through a fault occurrence and the recovery from a fault occurrence.

In accordance with the present invention, to alter the job default condition it is necessary to enter the diagnostics mode by activation of the diagnostics switch on the control console. It should be understood, however, that it is within the scope of this invention that a dedicated diagnostic switch might not be necessary but activation of some combination of existing switches. A predetermined customized default programming procedure is selected. Then by reactivation of the diagnostic switch, the system is returned to the job programming mode. Preferably, a suitable message on the screen of console 35 indicates that the customized default programming mode has been enabled. It should be noted that other preprogrammed job requirements might also be selected and changed at this time. That is, the machine can be set-up with selected dedicated buttons for preprogrammed parameters for certain job requirements. However, the invention is not directed to preprogramming for specific jobs, but rather to preprogramming and preselection of the set-up or default parameters that will be reverted to at machine power up and at machine cycle out. p A menu on the screen of console 35 will illustrate the parameters for the default condition as the default condition is currently set-up. With the default parameters displayed, the operator can make selections by activating suitable up/down scroll buttons. For example, by reference to Table 1 below, there are shown by way of example, ten (10) job default parameters in the first column of the Table. In the second column of the Table are illustrated first default values that have been initially selected for machine default. In particular, the mode is simplex to simplex, the paper supply is from tray 1, the stapler has not been requested, the copy output is to be uncollated in the face-up tray, and various other selections for the other job set-up parameters. In accordance with the present invention, as seen in the third column in Table 1, under second default values, the default values have been changed. In particular, the copy mode is duplex to duplex, paper supply from tray 2, the stapler has been requested and the copy output is collated copies to the finisher, with the other parameters remaining unchanged.

TABLE 1

| JOB SET-UP PARAMETER | 1ST DEFAULT VALUE | 2ND DEFAULT VALUE |
|---|---|---|
| Copy Mode | Simplex-to-Simplex | Duplex-to-Duplex |
| Paper Supply | Tray 1 | Tray 2 |
| Stapler | No Staples | Stapler |
| Copy Output | Uncollated Face Up Tray | Collate to Finisher |
| Contrast | Off | Off |
| Density | 14 | 14 |
| Exposure | 5 | 5 |
| Side 1 Shift | 0.0" | 0.0" |

TABLE 1-continued

| JOB SET-UP PARAMETER | 1ST DEFAULT VALUE | 2ND DEFAULT VALUE |
|---|---|---|
| Side 2 Shift | 0.0" | 0.0" |
| Reduction | 1st Reduction Preset | 1st Reduction Preset |

These set-up parameters, therefore, can be selectively changed and the machine will power up or time out to these particular parameters.

Once the parameters have been selected, preferably, the start button is pressed and these selected parameters are stored in the non-volatile memory or the input/output board 44. These parameters will also be displayed at the control console. Once the final selections are made, preferably the stop button is pressed to terminate the customized programming mode to return to the normal programming modes, or the return to machine operation. It should be noted that there are many variations of entry into the customized default set-up mode and making the appropriate selections contemplated within the scope of this invention.

Figure 5:
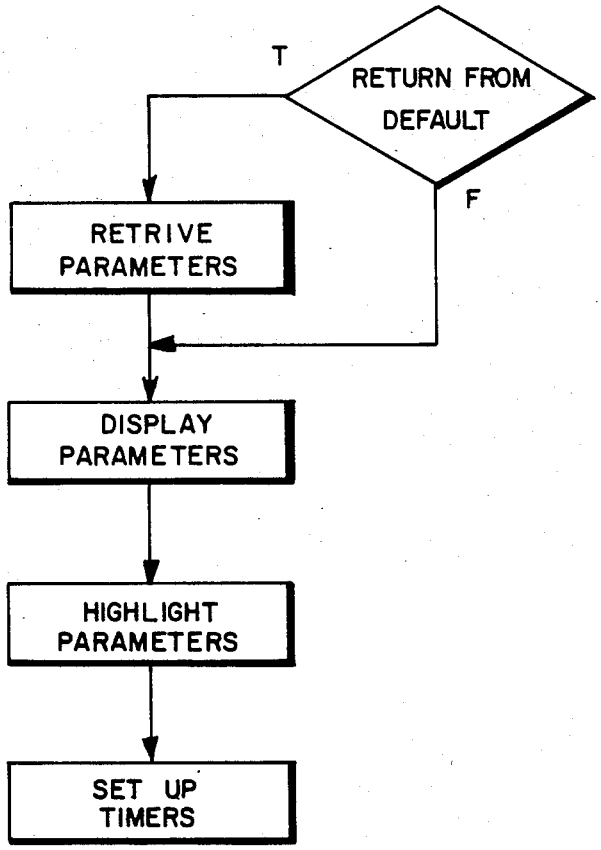
FIGS. 5 and 6 are flow charts illustrating the procedure for a customized job set-up.

With reference to FIG. 5, there is illustrated a flow chart of the operation during a return from a default. In particular, if there is a return from a default condition, that is there has been a time out after an end of job, power up, or at preselected time outs, the first step is to retrieve the parameters. That is, the parameters that have been set in non-volatile memory are retrieved and put in a suitable RAM memory. These parameters are then displayed during the job programming customized default routine and will be highlighted. Finally, suitable timers are set-up and started for a time period for a release for the job programming mode.

Figure 6:
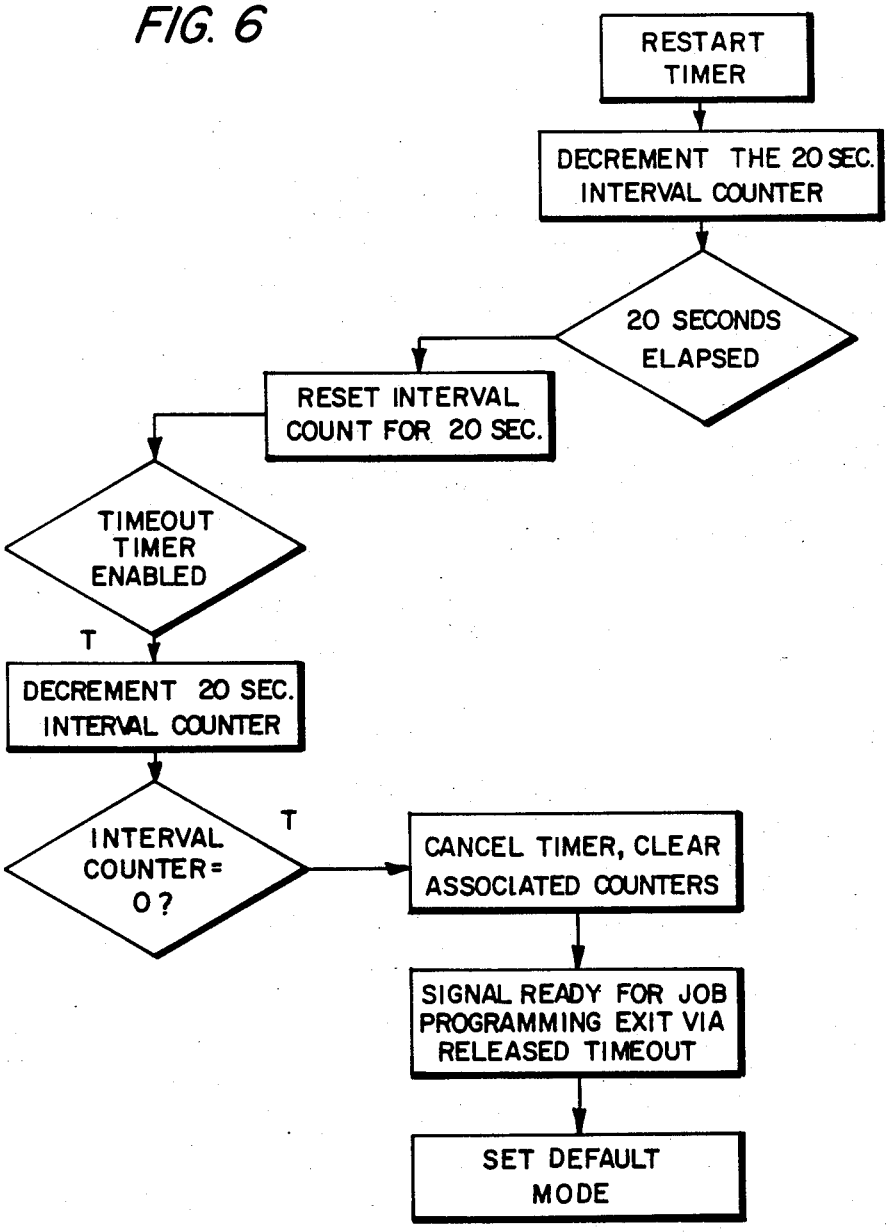

With reference to FIG. 6, there is a flow chart of the setting up of the timers. In particular, the timer is restarted. In addition, a 20 second interval counter is decremented and if the 20 seconds has elapsed, the count is reset for 20 seconds and the time out timer enabled. Upon entry into normal job programming from the customized programming mode, the time out selection timer is initialized and activated. When time out occurs, job programming is exited and the display reverts to the power up or walk up state.

While there has been illustrated and described what is presently considered to be a preferred embodiment of the present invention, it will appreciated that numerous changes and modifications are likely to occur to those skilled in the art, and it is intended in the appended claims to cover all those changes and modifications which fall within the true spirit and scope of the present invention.

I claim:

1. In a printing machine for producing impressions of an original, the printing machine having a photosensitive member, a plurality of discrete operating components cooperable with one another and the photosensitive member to electrostatically produce the impressions upon support material, and a controller having an operating console and a display, the console providing a plurality of switches to select job parameters, the machine upon cycle out at the end of a job requirement reverting to a given set of job parameters, said given set of job parameters being the dominant machines mode, the method of changing said dominant machine mode including the steps of:

initially setting up, said given set of job parameters to be returned to upon machine cycle out, displaying on the display said given set of machine parameters, and selectively changing at least one of the displayed parameters whereby upon machine cycle out the machine will revert to a second given set of job parameters, said second given set of job parameters being a new dominant machine mode.

2. The method of claim 1 wherein the controller includes a non-volatile memory and including the step of storing the second given set of job parameters in the non-volatile memory.

3. The method of claim 2 wherein the job parameters include copy mode, contrast, and density, including the steps of storing an original condition for copy mode, copy density and copy contrast in non-volatile memory, retrieving the selected parameters for copy mode, copy contrast, and copy density and displaying on the console, and selectively changing the copy mode, copy contrast, copy density parameters and restoring in non-volatile memory.

4. In a printing machine for producing impressions of an original, the printing machine having a photosensitive member, a plurality of discrete operating components cooperable with one another and a photosensitive member for electrostatically producing the impressions upon the support material, and a controller for selecting job parameters, a first set of job parameters being the dominant machine mode, the machine periodically reverting to said dominant mode, the controller including a non-volatile memory, an indication of said first set of job parameters being initially set in the non-volatile memory, the method of changing the dominant machine mode including the steps of:

retrieving at least one of said first set of job parameters from the non-volatile memory, changing said at least one of said first set of job parameters to a new parameter, and storing an indication of said new parameter in the non-volatile memory whereby the machine will periodically revert to a new dominant mode including said new parameter.

5. The method of claim 4 wherein upon the completion of producing impressions upon support material, the printing machine cycles down, including the step of reverting to the new dominant mode upon the machine cycling down.

* * * * *